US006474848B1

(12) United States Patent
Lahner et al.

(10) Patent No.: US 6,474,848 B1
(45) Date of Patent: Nov. 5, 2002

(54) ADJUSTABLE LIGHT

(75) Inventors: Ronald W. Lahner, Madison, CT (US); Mark E. Lahner, Madison, CT (US)

(73) Assignee: The Pennsylvania Globe Gaslight Co., North Branford, CT (US)

( * ) Notice: Subject to any disclaimer, the term of this patent is extended or adjusted under 35 U.S.C. 154(b) by 0 days.

(21) Appl. No.: 09/907,344

(22) Filed: Jul. 17, 2001

(51) Int. Cl.[7] ..... F21S 13/10

(52) U.S. Cl. ..... 362/431; 362/285; 362/418; 362/449; D26/67

(58) Field of Search ..... 362/363, 427, 362/431, 414, 285, 372, 418, 434, 277, 449; D26/67, 68, 70, 71

(56) References Cited

U.S. PATENT DOCUMENTS

| | | | | | |
|---|---|---|---|---|---|
| 776,360 | A | * | 11/1904 | Slinack | 362/431 |
| 1,575,245 | A | * | 3/1926 | Wurdack | 362/285 |
| D338,977 | S | * | 8/1993 | Ewing | D26/61 |

OTHER PUBLICATIONS

Pennsylvania Globe, Replica Gaslights—Boulevard #36. The Pennsylvania Globe Gaslight Co., 300 Shaw Road, North Branford, CT 06471 (Jan. 1, 1999). Sht.# 1.4.0.1.2 Sht.# 915196–1–2.

Pennsylvania Globe, Boulevard Replica Gaslights. The Pennsylvania Globe Gaslight Co., 300 Shaw Road, North Branford, CT 06471 (May 1, 1999).

Parklane Series Cut Off Luminaires. The Pennsylvania Globe Gaslight Co., 300 Shaw Road, North Branford, CT 06471 (Jul. 1, 1999). p. # 1.3.1.0.1, .2, .3, & .4.

Parklane II Replica Gaslight with Repli–Gasolere™ Reflector System. The Pennsylvania Globe Gaslight Co., 300 Shaw Road, North Branford, CT 06471 (Mar. 1, 2000). Sht.#979 P 4241.

Repli–Gasolere Burner Assembly. The Pennsylvania Globe Gaslight Co., 300 Shaw Road, North Branford, CT 06471 (Jan. 1, 2000). Sht. # 1.4.0.1.2.

* cited by examiner

*Primary Examiner*—Sandra O'Shea
*Assistant Examiner*—Hargobind S. Sawhney
(74) *Attorney, Agent, or Firm*—Delio & Peterson, LLC

(57) ABSTRACT

An exterior light includes a base, a transparent enclosure, an upper dome, a bulb mounted within the enclosure on a vertically adjustable bulb holder, a primary reflector mounted in the dome and a secondary reflector mounted on the bulb holder for adjustable movement relative to the bulb. The secondary reflector and bulb move together as the bulb holder is vertically adjusted. The adjustments of the secondary reflector relative to the bulb and the combination of the bulb and secondary reflector relative to the remainder of the exterior light allow the light to produce different standardized illumination patterns. The dome may be translucent and the light may be constructed as a reproduction of an antique gaslight, including one or more gas mantles illuminated by the bulb.

20 Claims, 3 Drawing Sheets

Type II

Type III

Type IV

ADJUSTABLE LIGHT

BACKGROUND OF THE INVENTION

1. Field of the Invention

This invention relates to exterior lights of the type used to illuminate streets and walkways. More particularly, the invention relates to exterior lights, including decorative exterior lights, that are adjustable to produce a desired illumination distribution.

2. Description of Related Art

There are many different types, styles and designs of exterior lights available on the market. However, most of these designs are not suitable for illuminating streets where the distribution of emitted light must meet rigorous standards as to glare, cutoff angle, throw and direction of emitted light, as well as the shape and size of the lighted area. Recognized industry groups such as the Illuminating Engineering Society (IES) set predetermined illumination distribution standards, such as the Type II, Type III and Type IV distribution patterns, among many others. Lighting engineers designing street lighting use these recognized standards to specify the desired lighting.

An exterior light capable of meeting one of the recognized illumination distribution standards (e.g. Type II) must be highly engineered. As a result; such a light is normally not adjustable to any other standard. The lighting engineer will purchase a Type II light to meet a requirement for a Type II lighting distribution, and a Type III light to meet a Type III lighting requirement, etc.

In addition to controlling the illumination pattern on the ground horizontally surrounding the light, it is important to control the vertical distribution of emitted light. Two predefined vertical light emission limits are referred to as "cutoff" and "semicutoff." Exterior lights providing adjustment of the vertical characteristics of the emitted light to cutoff and semicutoff as well as adjustment of the horizontal characteristics of the emitted light have not been available.

Furthermore, engineered exterior lights capable of meeting one of the predefined illumination distribution standards are commonly designed for government regulated street lighting applications and are typically available only in a generic modern style which many architects considered unattractive. Engineered exterior lights capable of being adjusted to meet multiple different IES lighting standards have not been available in decorative, antique or reproduction styles.

Even in applications that do not actually require the exterior light to meet a predefined illumination distribution standard, control over the lighting distribution is necessary to limit objectionable light pollution and glare. Exterior lights are available with various movable reflectors, shields and bulb holders to provide adjustment of the lighting pattern and control light trespass. However, adjustment of these designs is very difficult because changing the position of the bulb to change the lighting distribution has also changed the relationship between the bulb and the shield that controls light trespass. If it is desired to change the size or shape of the lighting pattern, which requires adjustment of the bulb position, the location of the shield must also be changed.

Bearing in mind the problems and deficiencies of the prior art, it is therefore an object of the present invention to provide an exterior light having a shield that can be adjusted relative to the bulb to control the horizontal distribution of light and light trespass and wherein the bulb and shield are mounted together and can be adjusted together to change the vertical light distribution without significantly altering the shape of the horizontal distribution and the relationship between the bulb and the shield.

It is another object of the present invention to provide an exterior light that has a decorative appearance, such as a reproduction street light gasolier, that produces a predetermined illumination distribution that matches an illumination standard set by a recognized industry group, such as the Illuminating Engineering Society.

It is yet another object of the present invention to provide an exterior light that can be adjusted to produce different selected predetermined illumination distributions from among multiple recognized illumination distribution standards set by a recognized industry group, such as the Illuminating Engineering Society.

It is a further object of the present invention to provide an exterior light that has an upper translucent portion providing controlled upwardly directed lighting.

Another object of the present invention is to provide an attractive exterior light that eliminates disability glare, has a low discomfort glare rating and a high visual comfort probability and is adjustable in cutoff, throw and illumination pattern to make it suitable for multiple different roadway lighting applications.

Still other objects and advantages of the invention will in part be obvious and will in part be apparent from the specification.

SUMMARY OF THE INVENTION

The above and other objects, which will be apparent to those skilled in art, are achieved in the present invention, which is directed to an exterior light including a base, a transparent enclosure mounted on the base, a bulb mounted within the enclosure on a vertically adjustable bulb holder, a shield mounted on the bulb holder for adjustable movement relative to the bulb and an upper dome cooperating with the bulb to produce an illumination distribution. As the bulb holder is vertically adjusted, the shield and bulb move together. Adjustment of the bulb holder and the shield changes the illumination distribution.

In one aspect of the invention, the upper dome has a primary reflector mounted inside it having a shape that cooperates with the bulb, the shield and the lower edge of the dome to produce a predefined illumination distribution according to an illumination distribution standard set by a recognized illumination standard setting society, such as the Illuminating Engineering Society. In the preferred design, the light can be adjusted to multiple different predetermined illumination standards, including Type II, Type III and Type IV roadway illuminations.

In another aspect of the invention the primary reflector includes at least one opening for transmitting light and the upper dome is translucent. This produces an upward illumination and an attractive appearance simulating early gasolier street light designs. In a different aspect of the invention the upper dome is internally metallized.

The shield may act as a secondary reflector and is preferably substantially vertical. The primary reflector preferably has at least two substantially planar reflective surfaces, and most preferably has at least four substantially planar reflective surfaces, two surfaces being inwardly facing and two being outwardly facing.

In the most highly preferred embodiment of the invention, the exterior light has a decorative appearance simulating a non-electric luminaire, such as an antique gasoliere design having at least one simulated gas mantle illuminated by the bulb.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1–4 of the drawings in which like numerals refer to like features of the invention.

Figure 1:
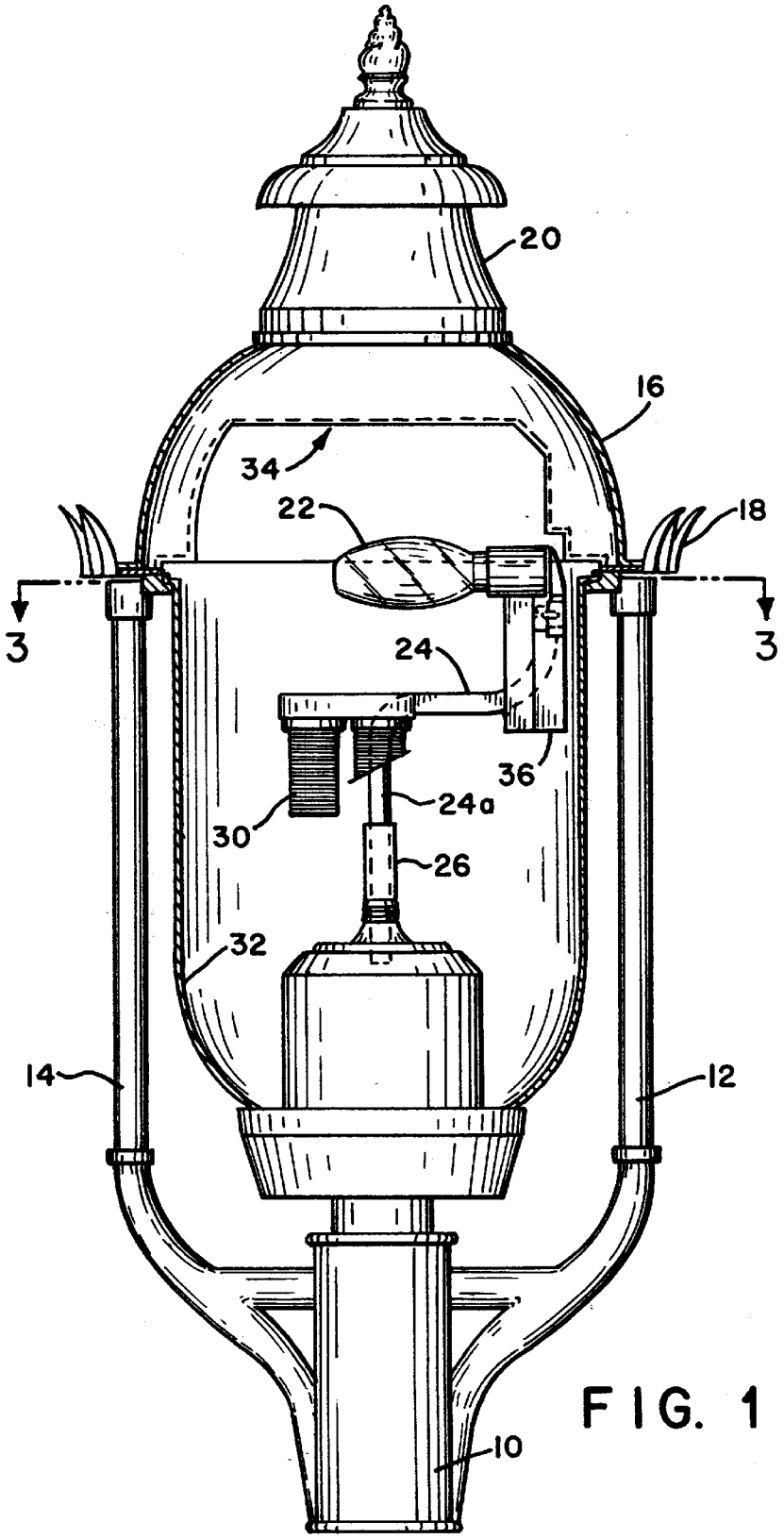
FIG. 1 is a side elevational view, partly in cross section, of an exterior light constructed in accordance with the present invention.

Referring to FIG. 1, the present invention includes a base 10 having vertical support rods 12, 14 supporting an upper dome 16, which is preferably translucent. A decorative crown 18 and a cap 20 are provided to simulate the appearance of an antique gas powered street light or gasolier.

A bulb 22 is mounted on a vertically adjustable bulb holder 24. Bulb holder 24 includes a vertical portion 24*a*, which slides vertically inside base support 26 to provide vertical adjustment of the bulb 22 relative to the upper dome 16. A setscrew 28 (see FIG. 2) allows the desired position of the lamp holder 24 to be retained after it has been correctly adjusted to provide the desired illumination distribution.

Also mounted on the lamp holder 24 are three replica gas mantles 30 (see FIG. 3), which are illuminated from above by the bulb 22 to provide the appearance of operating gas mantles in a gasolier. The bulb 22, as well as the bulb holder 24 and the mantles 30 are located inside a transparent enclosure comprising globe 32.

The illumination distribution, cutoff and throw characteristics of the present light are adjustable by adjusting the height of the bulb 22 relative to a primary reflector 34, and the lower perimeter of the upper dome 16 near the crown 18, as well as by adjusting the position of a secondary shield/reflector 36 relative to the bulb.

Figure 2:
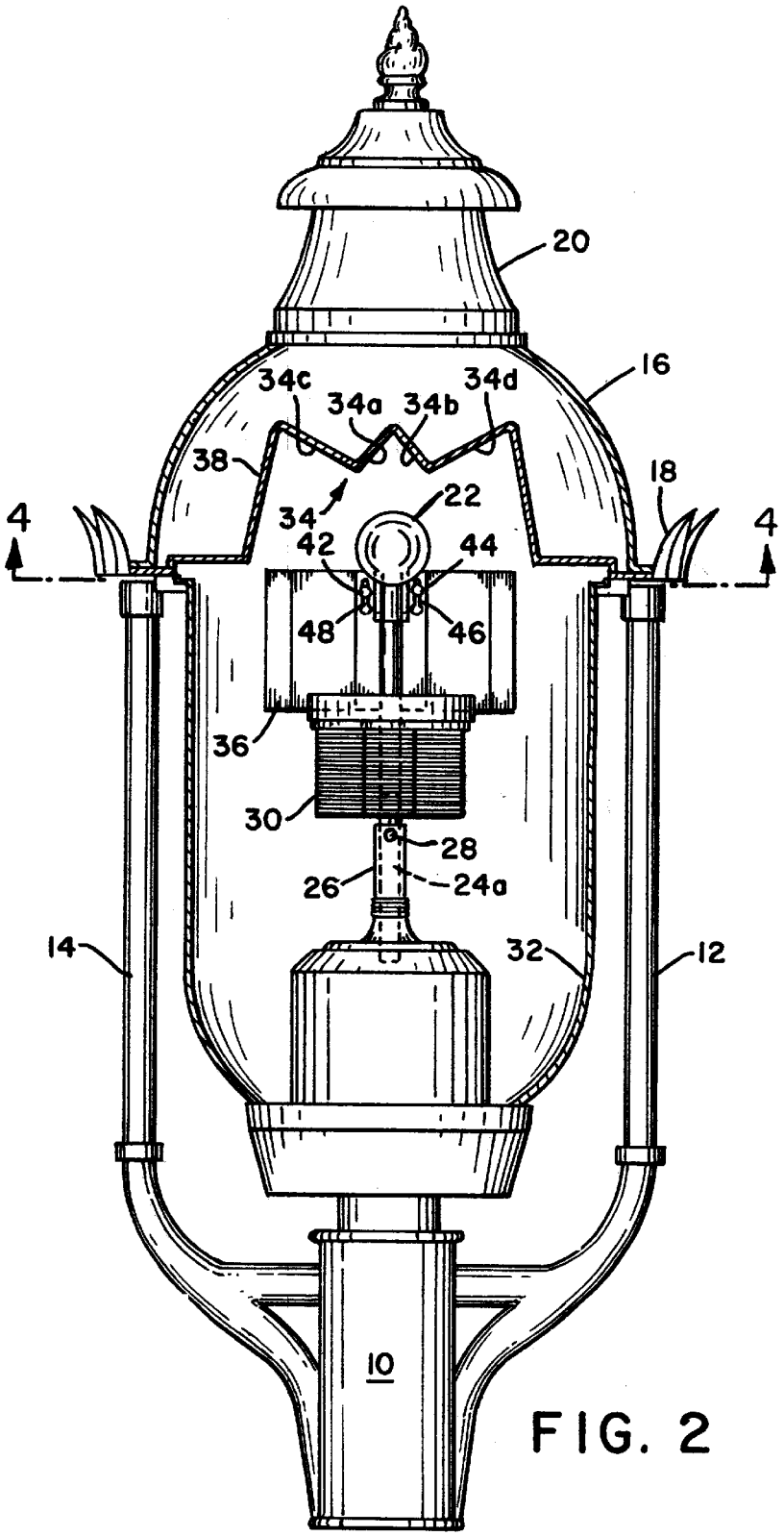
FIG. 2 is a front elevational view, partly in cross section, showing the exterior light of FIG. 1. The external vertical support rods seen in FIG. 1 have been turned ninety degrees with respect to FIG. 1 to avoid obscuring the details of the invention.
Figure 4:
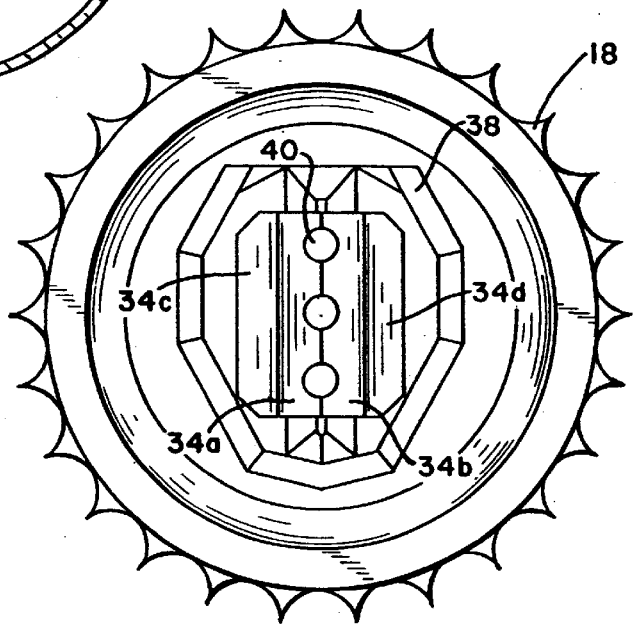
FIG. 4 is a cross sectional view of an exterior light according to the present invention, taken along the line 4—4 of FIG. 2.

The primary reflector 34 is supported on an inner translucent dome 38 and has four principal reflecting surfaces 34*a*, 34*b*, 34*c* and 34*d* (see FIGS. 2 and 4). Reflector surfaces 34*a* and 34*b* face inwards while reflective surfaces 34*c* and 34*d* face outwards. In the preferred design illustrated, the outwardly facing reflective surfaces 34*c* and 34*d* have an angle slightly greater than 60° relative to the vertical. The inwardly facing reflective surfaces 34*a* and 34*b* have an angle relative to the vertical slightly greater than 38°. The angles and sizes of the primary reflector cooperate with the location of the bulb relative thereto and the edges of the inner and outer portions of the upper dome 38 and 16 respectively to produce a Type II, Type III or Type IV lighting distribution in accordance with the standards of the Illuminating Engineering Society. By adjusting lamp holder 24 vertically, the different illumination distributions (see FIGS. 5*a*, 5*b* and 5*c*) can be obtained.

As can be seen in FIG. 4, the inwardly facing reflective surfaces 34*a* and 34*b* are provided with openings 40, which allow light to pass through the primary reflector and the inner dome 38 and illuminate the outer translucent dome 16 from within. This provides upward illumination and an attractive decorative appearance for the light, to simulate a gasolier design. If desired, the upper dome 16 can be made opaque and the inner dome 38 can be metallized to prevent upward illumination where dark skies are preferred.

Figure 3:
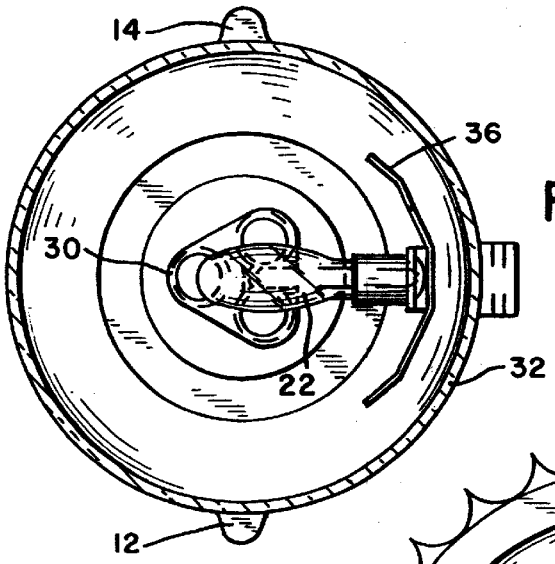
FIG. 3 is a cross sectional view of an exterior light according to the present invention, taken along the line 3—3 of FIG. 1.

As can be seen best in FIG. 3, the secondary shield/reflector 36 is also multi-segmented. The shield 36 prevents light from being transmitted in the direction of the shield. The shield serves the dual functions of preventing light trespass in one direction, and reflecting light thereby increasing illumination in the opposite direction. It is preferred that the primary reflector be highly reflective with a specular mirror finish. However, it is preferred that the secondary reflector/shield 36 have an unpolished white surface and provide some scattering of the reflected light.

As can be seen best in FIG. 2, the secondary reflector 36 is vertically adjustable on the bulb holder 34 (independent of the location of the bulb) by loosening screws 42 and 44 and sliding the secondary reflector 36 vertically along vertical slots 46, 48. Those of skill in the art may modify the angles and shapes of the primary and secondary reflectors to achieve different illumination distributions. However, the shapes and angles shown allow adjustment of the light to all of the principal desired roadway illumination patterns in the horizontal and vertical planes by adjustment of the relative positions of the bulb, the primary and secondary reflectors and the lower perimetrical edge of the dome.

Because the bulb and the secondary reflector 36 are commonly mounted on the bulb holder, once the location of the secondary reflector 36 relative to the bulb is set, it remains unchanged as the bulb 22 is raised or lowered with the bulb holder.

Figure 5A:
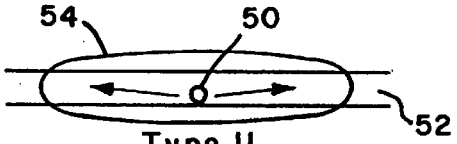
FIGS. 5*a*, 5*b* and 5*c* are plan views of the exterior light according to the present invention mounted near a roadway showing standard Type II, Type III and Type IV IES illumination distributions, respectively, that the exterior light can be adjusted to produce.
Figure 5B:
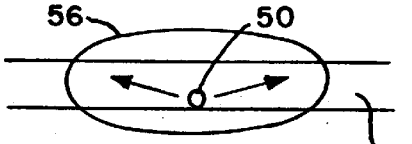
Figure 5C:
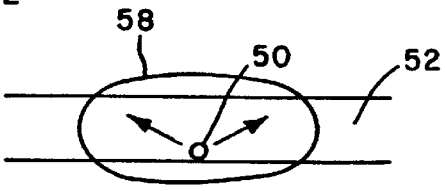

FIGS. 5*a*, 5*b* and 5*c* show standard Type II, Type III and Type IV IES Illumination distributions, respectively, that the exterior light according to the present invention can be adjusted to produce in the horizontal plane. The exterior light shown in FIGS. 1–4 is mounted on a pole at position 50 along the side of roadway 52.

The Illuminating Engineering Society in its "IES Lighting Handbook" defines an illumination distribution as Type II when the street side segment of the half-maximum candlepower isocandela trace within the longitudinal range in which the point of maximum candlepower falls (short medium or long) does not cross the 1.75 mounting height street side longitudinal roadway line.

A Type III is defined as where the street side segment of the half-maximum candlepower isocandela trace within the longitudinal range in which the point of maximum candlepower falls (short medium or long) extends partly or entirely beyond the 1.75 mounting height street side longitudinal roadway line, but not farther than the 2.75 mounting height street side longitudinal roadway line.

A Type IV distribution is defined as where the half-maximum candlepower isocandela trace within the longitudinal range in which the point of maximum candlepower falls (short medium or long) extends partly or entirely beyond the 2.75 mounting height street side longitudinal roadway line.

Limits for typical half-maximum candlepower isocandela traces for Types II, III and IV illumination distributions are marked with reference numbers 54, 56 and 58 respectively in FIGS. 5*a*, 5*b* and 5*c*.

The illumination distribution in the vertical plane can also be adjusted to "cutoff" or "semicutoff," as defined by the IES, by raising or lowering the bulb holder (and the bulb and secondary reflector mounted thereon). The "cutoff" adjustment produces an illumination pattern in the vertical plane such that very little light extends above the horizontal. Specifically, a cutoff adjustment produces a light distribution such that the candlepower per 1000 lamp lumens does not numerically exceed 25 (2.5 percent) at an angle of 90 degrees above nadir (i.e., horizontal) and 100 (10 percent) at a vertical angle of 80 degrees above nadir (i.e., at 10 degrees below horizontal). This applies to any lateral angle around the exterior light.

The semicutoff adjustment for the exterior light of this invention is achieved with a slightly lower position for the bulb holder relative to the position needed for the cutoff position. The semicutoff adjustment produces an illumination pattern in the vertical plane such that the candlepower per 1000 lamp lumens does not numerically exceed 50 (5 percent) at an angle of 90 degrees above nadir (horizontal) and 200 (20 percent) at a vertical angle of 80 degrees above nadir (10 degrees below horizontal).

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An exterior light comprising:

a base;

a transparent enclosure mounted on the base;

a bulb mounted within the enclosure on a vertically adjustable bulb holder;

a shield mounted on the bulb holder for adjustable movement relative to the bulb, the shield and bulb moving together as the bulb holder is adjusted vertically; and an upper dome cooperating with the bulb to produce an illumination distribution, the illumination distribution being adjustable by adjustment of the bulb holder and the shield.

2. The exterior light according to claim 1 further including a primary reflector mounted in the upper dome.

3. The exterior light according to claim 2 wherein the primary reflector includes at least one opening for transmitting light.

4. The exterior light according to claim 1 wherein the upper dome is translucent.

5. The exterior light according to claim 4 further including a primary reflector mounted in the upper dome.

6. The exterior light according to claim 5 wherein the primary reflector includes at least one opening for transmitting light and illuminating the translucent upper dome.

7. The exterior light according to claim 1 wherein the upper dome is internally metallized.

8. The exterior light according to claim 1 wherein the illumination distribution is adjustable to a predetermined illumination distribution standard.

9. The exterior light according to claim 8 wherein the illumination distribution is adjustable to a predetermined illumination distribution standard set by the Illuminating Engineering Society.

10. The exterior light according to claim 8 wherein the illumination distribution is adjustable to produce a selected illumination distribution from among a plurality of recognized illumination distribution standards.

11. The exterior light according to claim 10 wherein the recognized illumination distribution standards are set by the Illuminating Engineering Society.

12. The exterior light according to claim 1 wherein the illumination distribution is adjustable to produce a Type II, a Type III or a Type IV illumination distribution set by the Illuminating Engineering Society.

13. The exterior light according to claim 1 wherein the shield comprises a secondary reflector.

14. The exterior light according to claim 1 wherein the shield is substantially vertical.

15. The exterior light according to claim 1 wherein the primary reflector has at least two substantially planar reflective surfaces.

16. The exterior light according to claim 1 wherein the primary reflector has at least four substantially planar reflective surfaces.

17. The exterior light according to claim 1 wherein the primary reflector has at least two inwardly facing substantially planar reflective surfaces and at least two outwardly facing substantially planar reflective surfaces.

18. The exterior light according to claim 1 wherein the base, dome and enclosure have a decorative appearance cooperating to simulate a non-electric luminaire.

19. The exterior light according to claim 18 further including at least one simulated gas mantle illuminated by the bulb.

20. An exterior light comprising:

a decorative housing simulating an antique gaslight including a transparent enclosure;

a bulb mounted within the enclosure on a vertically adjustable bulb holder; an upper translucent dome illuminated by the bulb, at least one simulated gas mantle illuminated by the bulb and visible through the enclosure;

a primary reflector mounted in the dome; and a secondary reflector mounted on the bulb holder, the secondary reflector being adjustable relative to the bulb, the secondary reflector and bulb moving together as the bulb holder is adjusted;

the dome having a lower perimetrical edge cooperating with the bulb, the primary reflector and the secondary reflector to produce a predefined illumination distribution according to an illumination distribution standard set by a recognized illumination standard setting society.

* * * * *